US005381714A

United States Patent [19]

Kasha

[11] Patent Number: 5,381,714

[45] Date of Patent: Jan. 17, 1995

[54] FAN-BRACING AND X-BRACING FOR CELLO AND DOUBLE BASS

[76] Inventor: Michael Kasha, 3260 Longleaf Rd., Tallahassee, Fla. 32310

[21] Appl. No.: 268,717

[22] Filed: Jun. 30, 1994

Related U.S. Application Data

[63] Continuation of Ser. No. 875,040, Apr. 28, 1992, abandoned.

[51] Int. Cl.[6] ..... G10D 1/02

[52] U.S. Cl. ..... 84/276; 84/275; 84/291

[58] Field of Search ..... 84/276, 274, 291, 267, 84/294, 268, 275

[56] References Cited

U.S. PATENT DOCUMENTS

| | | | |
|---|---|---|---|
| 1,819,796 | 8/1931 | Sherman | 84/276 |
| 2,202,208 | 5/1940 | Kapelman | 84/276 |
| 3,014,394 | 12/1961 | Szymanski | 84/276 |
| 3,474,697 | 10/1969 | Kaman | 84/291 |
| 3,685,385 | 8/1972 | Rendell | 84/291 |
| 3,892,159 | 7/1975 | Houtsma | 84/291 |

*Primary Examiner*—Michael L. Gellner
*Assistant Examiner*—Cassandra C. Spyron
*Attorney, Agent, or Firm*—Jacobson, Price, Holman & Stern

[57] ABSTRACT

The replacement of the bass-bar which is traditionally installed on the underside of the top-plate of a cello or double-bass and substituting a more elastic suspension system of radiating bars. In one arrangement, the bass-bar is replaced by a short support-bar located under the bass-foot of the bridge and has an arch cut at its mid-point in alignment with the bridge and a set of four fan-braces radiate outward at an angle to the alignment axis of the support-bar and are firmly glued to the sides of the support-bar with the fan-braces distributing the static load borne by the support-bar over the whole area of the top-plate. In another arrangement, the traditional bass-bar is replaced by a pair of tapered vibration-bars which cross in an integrally glued cross-lap joint with the region of crossing being provided with a slight arch-cut profile with the load from the X-brace region thus being spread over the entire top-plate of the instrument.

5 Claims, 2 Drawing Sheets

FAN-BRACING AND X-BRACING FOR CELLO AND DOUBLE BASS

This is a continuation of application Ser. No. 07/875,040, filed Apr. 28, 1992 which was abandoned upon the filing hereof.

BACKGROUND OF THE INVENTION

1. Field of the Invention

The present invention generally relates to improvements in stringed musical instruments and more particularly the replacement of the bass-bar which is traditionally installed on the underside of the top-plate of a cello or double bass and substituting a more elastic suspension system of radiating bars. In one arrangement, the bass-bar is replaced by a short support-bar located under the bass-foot of the bridge and has an arch cut at its mid-point in alignment with the bridge and a set of four fan-braces radiate outward at an angle to the alignment axis of the support-bar and are firmly glued to the sides of the support-bar with the fan-braces distributing the static load borne by the support-bar over the whole area of the top-plate. In another arrangement, the traditional bass-bar is replaced by a pair of tapered vibration-bars which cross in an integrally glued cross-lap joint with the region of crossing being provided with a slight arch-cut profile with the load from the X-brace region thus being spread over the entire top-plate of the instrument.

2. Description of the Prior Art

In the violin family of instruments, aside from all other similarities of form and construction and differences of dimension and shape, there are two crucial acoustical or vibrational elements in common: the sound-post, and the bass-bar.

The sound-post is a dowel of wood wedged between the top-plate and the back, and is located near (but not under) the treble-foot of the bridge. Apparently, this member has its origins in antiquity, and originally had a structural-support function, as it appears to have been disposed symmetrically near the bridge, supporting thin instrument tops against collapse under strong tension applied to the bridge.

In the violin family it was discovered that by setting the post with special tongs or forceps near the treble-foot of the bridge, but somewhat behind it toward the string tail-piece, the most brilliant treble tones would ensue. Location of the sound-post is thus a critical adjustment on the part of the luthier.

It is commonly said that the purpose of the sound-post is to transmit vibrations of the top-plate to the back-plate of the instrument (allegedly for sound enhancement). This is a false appraisal, and if it had been correct, a more efficient placement of the sound-post could be considered to be directly under the treble-foot of the bridge—a location which kills upper register response. Giltay, a Dutch engineer-physicist who did extensive research on violins, proved experimentally that the sound-post creates a null-point or node for high-frequency top-plate vibration. This is exactly analogous to playing harmonics on a string by tapping with the finger a nodal point on a string. Thus, a high frequency, small circular zone is created, with the treble-foot at a maximum (antinode) of vibration, and the sound-post at a node or null-point vibration. This is a local top-plate tuning-in of high frequency plate modes.

No modification of sound-post structure is contemplated in this invention.

A century before Stradivari the efficacy of a "bass bar" was accidentally discovered by Gasparo da Salo. He found that a ridge of wood centered under the bass-foot of the bridge and extending the full length of the underside of the top-plate greatly enhanced the bass response of a violin. Stradivari glued in a spruce bass bar instead of carving a ridge of wood in the underside of the top-plate. This made it possible to replace the bass bar and to modify it. As steel strings replaced gut, and string tension and bridge pressure rose, the violin bass bar of today became twice as high as that of Stradivari's time. In applying the bass bar to the viola, cello and string bass, progressively sturdier bass bars were introduced, until a veritable fence-picket appears as the bass bar in the cello and string bass (bass viol).

The virtuoso musician perceives an increasing deficiency in low-register tones as one goes up the series violin-viola-cello-bass: the low fundamental is missing or quenched in the bass register. The result is progressively a "drier" or more nasal tone, with upper partials dominating.

If we study the desired function of the bass bar and its actual action, we can diagnose the source of its deficiency. Without a bass bar the bass-foot of the bridge would drive local vibrations of the top-plate, emphasizing the high harmonics of the string vibration. A bass bar is then introduced to couple the local bridge motion over an extended region of the top-plate, so that low-frequency components of the string vibration could be coupled.

The contradiction then exists that the bass bar is highest and therefore stiffest just at the point (under the bass-foot of the bridge) where the amplitude of motion should be greatest.

For the violin and viola, I previously introduced arch-cuts in the bass bar centered under the bass-foot of the bridge. This arch-cut then permits flexing of the bass bar at its center, but still supporting string tension, and now more efficiently coupling bridge motion to full top-plate motion. The result was that for violins, and especially for violas, unplayable student instruments became fairly decent, and the low register was much enriched, especially in the viola. Long-term tests under full string tension showed no perceptible top failure. An unexpected dividend was the improvement of the overall range of the instrument, especially the treble. The arched bass bar evidently does function to strengthen fundamental components of each note.

For the string-bass (bass viol) and also cello, because of their much greater dimension, another engineering physics design element is introduced here. A mere arch-cut in the heavy bass bar of these instruments would do little to reduce the mass and general stiffening effected by those heavy bars. My fan-bracing design uses a short, arched support-bar which imparts some flexibility and a greatly reduced mass. This short bar should result in a more rapid action of greater amplitude. The principal change is in the introduction of fan-bracing as highly flexible coupling-bars attached to the short support-bar. The overall effect should be a coupling array which facilitates high-amplitude bass-register vibrations to be spread over the full length of the top-plate. The true bass fundamental should then be reinforced.

A Belgian engineer-physicist who studied violin mechano-acoustics states that the violin design problem is one which no engineer has faced: a highly flexible, dynamic design (for good sound production) simultaneously with a very stiff, static characteristic (for support of high string tension and consequent bridge force load). I believe that the fan-bracing design introduced permits the sustaining of a high bridge load and at the same time permits greatly improved low-frequency response by a more responsive all-top-plate motion.

I have also introduced an X-bracing system to replace the traditional bass-bar in a cello and double bass in which a pair of tapered vibration bars cross in an integrally glued cross lap joint which supports the static load with the load from the X-brace region being spread over the entire top-plate which also is believed to permit greatly improved low frequency response by a more responsive all top-plate motion.

SUMMARY OF THE INVENTION

An object of the present invention is to provide improvements in the cello and double bass instruments by removing the traditional bass-bar normally installed in the underside of the top of such instruments and replacing the heavy traditional bass-bar with a more elastic suspension system of radiating bracing bars.

Another object of the invention is to provide an elastic suspension system to replace the heavy traditional bass-bar of the cello and double bass by utilizing two different arrangements both of which maintain structural integrity by bearing the static load of the strings and at the same time permitting a much higher amplitude of vibratory motion thereby yielding a true bass note fundamental for the C-string of the cello and the E-string of the double bass.

A further object of the invention is to provide the elastic suspension system as set forth in the preceding objects in which one embodiment includes a fan-bracing system in the form of a short support-bar located under the bass-foot of the bridge and is provided with an arch-cut at its point of alignment with the bridge combined with a set of four fan braces radiating outward at an angle to the alignment axis of the support-bar and being glued firmly to the sides of the support-bar to distribute the static load borne by the support-bar over the whole area of the top-plate and the dynamic role of the fan-bracing is enhanced by its greater elasticity and lower mass.

A still further object of the invention is to provide an X-bracing system as a replacement for the traditional bass-bar in the form of a pair of tapered vibration bars which cross in an integrally glued cross lap joint with the static load of the string tension being borne by the region of crossing with the bars spreading the load from the cross lap region over the entire plate of the instrument with the dynamic function being enhanced by the lighter dimensions of the vibrating bars along with their lower mass and greater elastic compliance.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
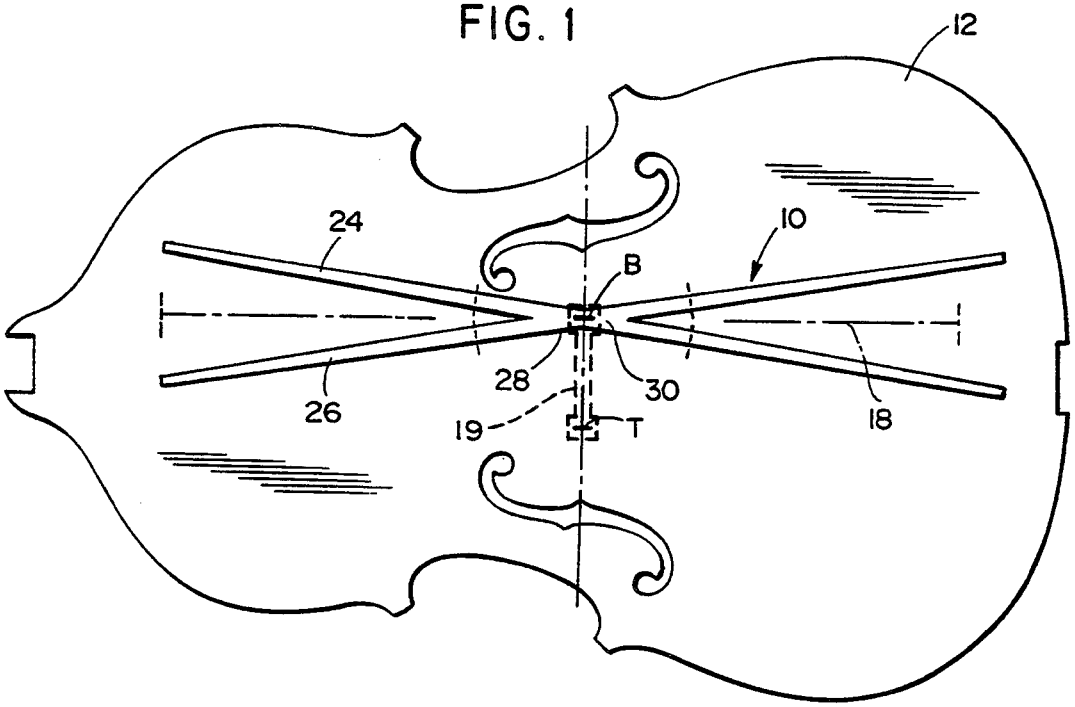
FIG. 1 is a plan view taken from the underside of the top-plate of a cello and double bass illustrating the X-bracing system of the present invention.
Figure 2:
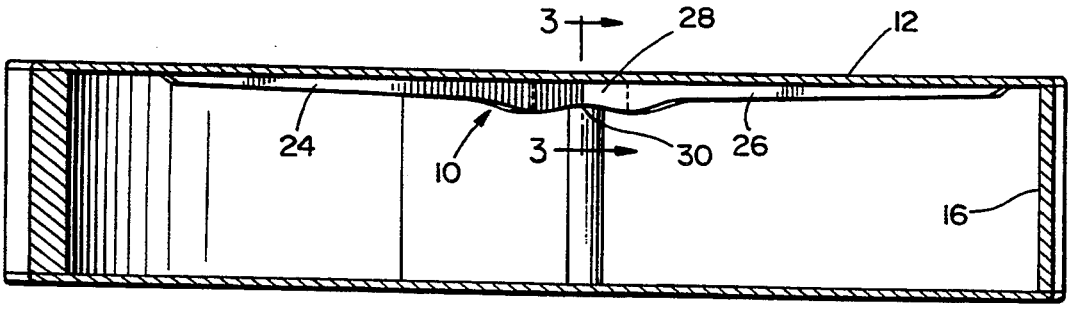
FIG. 2 is a longitudinal sectional view illustrating the X-bracing in elevation.
Figure 3:
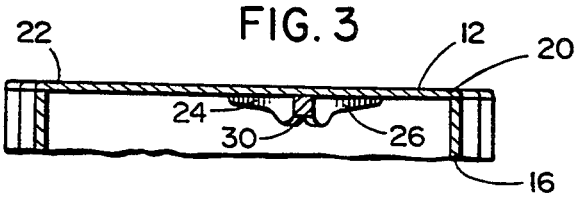
FIG. 3 is a detailed sectional view taken along section line 3—3 on FIG. 2 directed toward the treble side of the top-plate.
Figure 4:
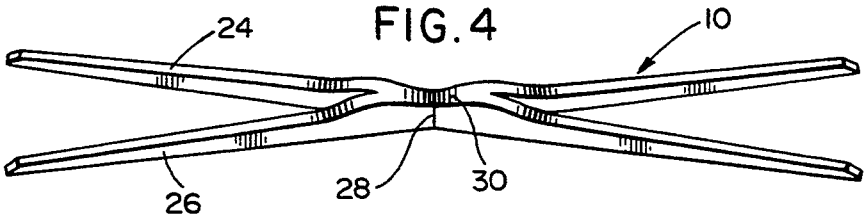
FIG. 4 is a perspective view of the X-bracing illustrating the cross lap joint.

FIGS. 1–4 of the drawings illustrate the X-bracing generally designated by reference numeral 10 and, in FIG. 1, is illustrated from the underside of the top-plate 12 of a cello and double bass which is of conventional construction and includes a back 14 and peripheral wall 16 with the bass-foot position of the bridge being designated at B and the treble-foot position of the bridge being designated at T. The plan profile of a conventional bridge is shown in FIG. 1 in dashed lines and is designated by reference numeral 19. Also illustrated in FIG. 1 in broken line and designated by reference numeral 18 is the position and extent of a traditional bass-bar in a cello and double bass instrument which is replaced by the X-bracing 10 of the present invention. As illustrated, the X-bracing 10 is offset toward the bass side 20 of the top-plate 12 with the treble side 22 having the treble-foot position T of the bridge an equal distance away from the peripheral wall.

The X-bracing system includes a pair of tapering bars 24 and 26 which cross each other at their center in a half-lap joint 28 which is integrally glued to form a unitary structure with an arch-cutout 30 being provided in the lap joint on the lower surface of the cross bracing 10 when it is applied to the underside of the top-plate 12. The static load produced by the string tension on the bridge is borne by the region of crossing of the vibration bars which is provided with the slight arch-cutout profile to assist in the dynamic function of the cross bracing. With this arrangement, the load from the X-brace or cross-over region is spread over the entire top-plate of the instrument and the dynamic function is enhanced by the lighter dimensions of the vibrating bars, their lower mass and greater elastic compliance.

Standard luthier craftsmanship is utilized in the installation of the X-bracing system with the bracing struts being glued-in under tension and with the grain in the spruce struts being normal to the top-plate surface. The X-bracing system also can be applied to the violin and viola with the same basis of improving instrumental response, especially in bass register of the instruments and this basic pattern would be especially effective in junior-sized instruments used by students.

The vibration bars 24 and 26 may taper from a width of $\frac{1}{2}''$ adjacent the cross lap joint 28 to $\frac{3}{8}''$ at their outer ends. The total lengthwise dimension of each brace (for a $\frac{3}{4}$ double-bass) is $35\frac{3}{4}''$ with the vertical dimension of each vibration bar at the outer end being $\frac{3}{8}''$ with the last $\frac{1}{2}''$ of each end of each vibration bar being inclined at approximately a 45° . The vertical dimension of each vibration bar is $\frac{3}{4}''$ at its inner end with the cross over portion of the vibration bars as indicated by the broken lines in FIG. 1 curving upwardly from the ¾" height portion to an apex height of 1.2" then curving down to the center at a height of 1".

Figure 5:
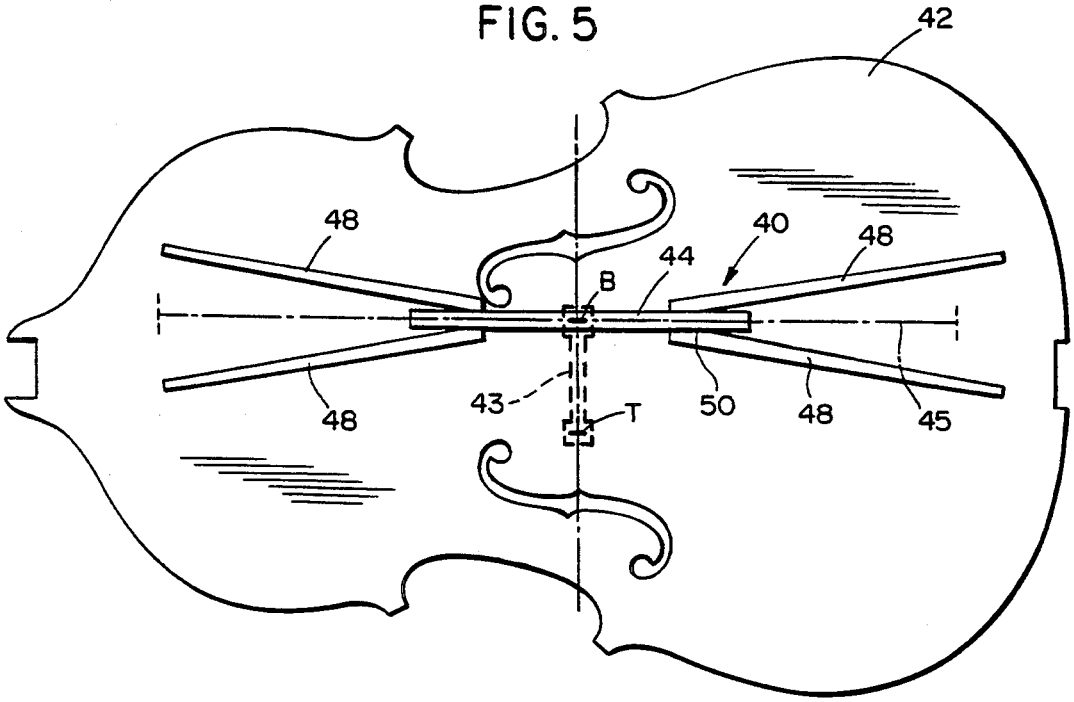
FIG. 5 is a plan view taken from the underside of the top-plate of a cello and double bass illustrating the fan-bracing arrangement of the present invention.

FIGS. 5–8 illustrate the fan-bracing system generally designated by reference numeral 40 which, in FIG. 5 is illustrated on the underside of the top-plate 42 which is of the same construction as the top-plate 12 and including a bridge bass-foot position B and a treble bridge-foot position T. The plan profile of a conventional bridge is shown in FIG. 5 by dashed lines and is designated by reference numeral 43. The fan-bracing system 40 includes a support-bar 44 oriented in underlying relation to the bass-foot position B and the fan-bracing replaces the usually provided and traditional bass-bar that normally would be positioned along broken line 45. The support-bar includes an arched cutout area 46 on its lower edge and four radially extending fan-braces or vibration bars 48 are glued to the side surfaces of the support-bar as at 50 with the braces 48 radiating outward at an angle to the alignment axis of the support-bar 44. The fan-braces 48 distribute the static load borne by the support-bar over the whole area of the top-plate and the dynamic role of the fan-bracing system is enhanced as compared to the traditional bass-bar by its greater elasticity and lower mass.

Figure 6:
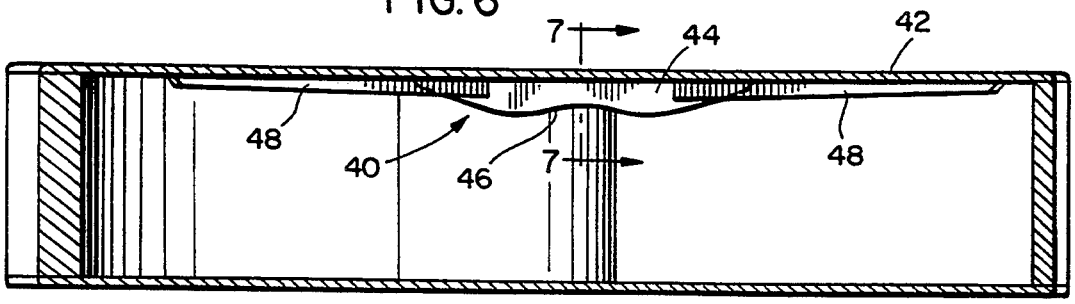
FIG. 6 is a longitudinal sectional view illustrating the fan-bracing in side elevation.
Figure 7:
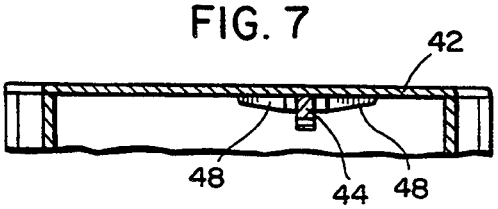
FIG. 7 is a detailed sectional view taken substantially upon a plane passing along section line 7—7 on FIG. 6 in the direction of the treble side of the top-plate.
Figure 8:
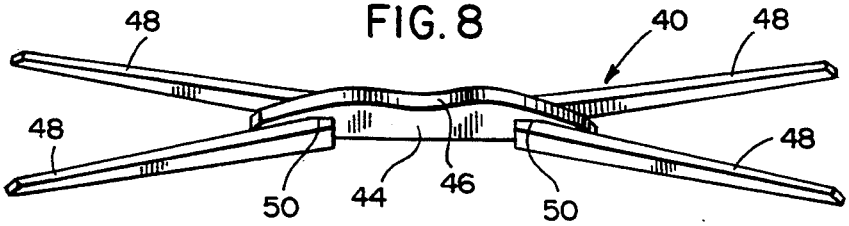
FIG. 8 is a perspective view of the fan-bracing of the present invention.

Each of the bars or vibration bars 48 taper from a width of ½" at their inner ends to ⅜" at their outer ends with the height of the bars being ¾" at their inner end and ⅜" at their outer ends with the outer ½" of each brace-bar being inclined as illustrated in FIGS. 6 and 8. The ends of the brace-bar are approximately 2½" from the center line of the existing bass-bar and extends beyond the traditional bass-bar. The inner corners of the vibration bars 48 are beveled or inclined and set inwardly 2½" from the end of the support-bar 44. The support-bar 44 has a constant width of ¾" and curves upwardly from each end to an apex of 1⅜" on both sides of the arch-cutout which has a height of 1". The support-bar 44 is located under the bass-foot position B of the bridge and has an arch-cut on its under surface. The vibration bars are glued firmly to the sides of the support-bar with four fan-braces radiating outwardly at an angle to the axis of the Support-bar. The fan-braces 48 distribute the static load borne by the support-bar over the whole area of the top-plate. The dynamic role of the fan-bracing system is enhanced as compared with that of the traditional bass-bar by its greater elasticity and lower mass with the mechanical impedance of the system being verifiable by direct dynamic test in comparison with the values for traditional bass-bar instruments.

The traditional bass-bar is a relatively sturdy structural member whose dimensions depend on the size of the instrument. In a full size double bass, this bar can be 1" thick and have a height of between 1½" to 2" at its highest point under the bridge and tapering to a narrow dimension at its end whereas a ¾ size double bass usually has a bass-bar that is 1½" high at the bridge axis and tapers to its ends with the thickness being ⅝". In the cello, the bass-bar is proportionately reduced in conformity with the scale of the smaller instrument but in all instances, a sturdy strut of wood is glued in as a bass-bar under the position of the bass-foot of the bridge. In the traditional bass-bar construction which has been in use for about two centuries, the bass-bar functions structurally to support the static load of the instrument bridge under the tension of the strings. The mechanosonic (acoustical) role forms a second function of the bass-bar. The vibrations of the bridge, especially of a bass-foot driven by the bass register strings set the top-plate in motion. This driving of the top-plate would be local (corresponding to higher frequency harmonics of the top-plate fundamental if there were no bass-bar present). Thus, the traditional bass-bar has the mechanical function of distributing the local top-plate distortion over the entire area of the top-plate, and its dynamic function depending on the elastic properties of the bass-bar. The two functions of the traditional bass-bar represent opposed and competing functions. The construction of bowed stringed instruments also has the requirement of structural integrity as a prime requisite. This has resulted in instruments of the cello and double bass scale which have highly inhibited dynamic vibrational response in bass register. In the cello the fourth or C-string sound is nasal and non-brilliant and in the double bass, the sound of the fourth or E-string is dull and decidedly quenched. Musicians who play these instruments are aware of this deficiency.

As compared to the traditional bass-bar, the present invention replaces the heavy traditional bass-bar and substitutes a more elastic suspension system of radiating bars. Both variations disclosed in FIGS. 1–4 and FIGS. 5–8 respectively maintain structural integrity by bearing the static load of the strings and at the same time permit a higher amplitude of vibratory motion thereby yielding a true bass-note fundamental for the C-string of the cello and the E-string of the double bass. By using either of the elastic suspension systems of this invention, the harmonic improvement over the entire octave range of the instrument is perceptible. In smaller scale violins and violas, a more delicate approach to the bass-bar system of the present invention is used so that in those instruments, the G-string (violin) and C-string (viola) the harmonic deficiencies were less severe than the corresponding bass register quenching in the cello and double-bass thus enabling a more delicate approach to the bracing system to be employed.

In comparing the acoustical advantages of the present invention with existing instruments, it is pointed out that the quality of the sound waves generated by a musical instrument are the ultimate test of the value of that instrument and its structural characteristics and is really the only test which counts. The opinion of the virtuoso musician and of the experienced musical auditor are primary. Thus, in order for an invention to gain acceptance and recognition, such changes must be recognized by professional judgment of the musical sound produced. Supplementing the musical judgment is the requirement of a demonstrable difference in acoustical output of the improved construction. Physically, a number of increasingly subtle and measurable criteria are used. The two basic criteria are the real-time harmonic spectrum which is absolutely primary for judging a musical instrument sound. In the bowed instrument, the Backhaus Criterion is basic in which a brilliant tone is correlated with a harmonic spectrum in which the fundamental note is dominant and the higher harmonics fall off in intensity progressively with harmonic number. A non-brilliant tone is correlated with a harmonic spectrum in which the fundamental note is weak or missing and some higher harmonic is the strongest with such a tone sounding nasal, dry, raw, non-brilliant and does not project well, as its basic tone is not defined. A real time harmonic analyzer for measuring sound output of an instrument in an anechoic chamber is required so that the harmonic display is instantly available for each played or struck note. The second criterion is the power spectrum in which relative acoustical power or loudness of each note played generates a power spectrum or acoustical amplitude spectrum. These measurements can be made with an impedance tube or in an anechoic chamber, with both devices having frequency limits which must exceed the tonal range of the instrument to be studied. By using such instruments, the relative power spectrum of different instruments can be compared. The power spectrum does rate in importance with the harmonic spectrum from the musical point of view, but every musician desires that an instrument "speaks" so the better the output the more desirable is the instrument after the brilliance is assured.

The two variations of the elastic suspension system including the X-bracing arrangement and the fan-bracing arrangement which replaces the heavy traditional bass-bar of the cello and double-bass effectively improve the structural role of supporting the static load of the instrument bridge under string tension and the acoustical role of distributing the top-plate distortion over the entire area of the top plate which permits a much higher amplitude of vibratory motion to yield a true bass-note fundamental for the C-string of the cello and the E-string of the double-bass with the same advantages being obtained on a smaller scale for the G-string of the violin and C-string of the viola.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A bass-bar structure in a bow string instrument, either cello or double-bass, said instrument having a top plate, a bridge having a bass foot and treble foot engaging an upper side of said top plate, said bass-bar structure comprising a bracing means secured firmly to an underside of said top plate, said bracing means including a bracing system, said bracing system having a center positioned in directly underlying aligned relation to said bass foot on said bridge and bracing bars radiating from said center to distribute string tension and vibrational load of the bridge acting on the top plate over a large area of said top plate.

2. The bass-bar structure as defined in claim 1 wherein said bracing system includes a pair of crossed bars defining X-bracking having a cross-lapped central portion directly underlying said bass foot on said bridge, said crossed bars defining said bracing bars radiating from said central portion.

3. The bass-bar structure as defined in claim 2 wherein said cross-lapped central portion has a concave profile along a lower surface thereof, said concave profile directly underlying the bass foot on the bridge, said crossed-bars being generally tapered toward bar extremities remote from the central portion of the cross-lapped bars.

4. The bass-bar structure as defined in claim 1 wherein said bracing system includes a short support bar having a center directly underlying the bass foot on said bridge, said bracing bars radiating from and being secured to side surfaces of said support bar at each end thereof and fanning generally outwardly therefrom.

5. The bass-bar structure as defined in claim 4 wherein said support bar has a concave profile along a lower surface thereof, said concave profile directly underlying the bass foot on said bridge, said bracing bars being generally tapered toward bar extremities remote from said support bar.

* * * * *